US011034540B2

(12) United States Patent
Miyauchi et al.

(10) Patent No.: US 11,034,540 B2
(45) Date of Patent: Jun. 15, 2021

(54) MEDIUM TRANSPORT DEVICE AND IMAGE FORMING APPARATUS

(71) Applicant: FUJIFILM Business Innovation Corp., Tokyo (JP)

(72) Inventors: Riwako Miyauchi, Kanagawa (JP); Masato Minagawa, Kanagawa (JP); Hiroshi Kawamoto, Kanagawa (JP); Satoshi Watanabe, Kanagawa (JP); Tomohiro Ueno, Kanagawa (JP); Kiminobu Tsutada, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 203 days.

(21) Appl. No.: 16/392,567

(22) Filed: Apr. 23, 2019

(65) Prior Publication Data

US 2020/0103810 A1 Apr. 2, 2020

(30) Foreign Application Priority Data

Sep. 28, 2018 (JP) ..... JP2018-183480

(51) Int. Cl.
*B65H 29/58* (2006.01)
*G03G 15/00* (2006.01)

(52) U.S. Cl.
CPC ..... *B65H 29/58* (2013.01); *G03G 15/6529* (2013.01); *B65H 2404/741* (2013.01)

(58) Field of Classification Search
CPC ..... B65H 5/36; B65H 29/58; B65H 29/60; B65H 85/00; B65H 2404/63;
(Continued)

(56) References Cited

U.S. PATENT DOCUMENTS

2013/0156479 A1* 6/2013 Nara ..... B65H 85/00 399/401
2014/0159303 A1* 6/2014 Suzuki ..... G03G 15/234 271/225

(Continued)

FOREIGN PATENT DOCUMENTS

JP 5479984 4/2014

*Primary Examiner* — Prasad V Gokhale
(74) *Attorney, Agent, or Firm* — JCIPRNET

(57) ABSTRACT

A medium transport device includes a medium guide member, a driving source, a first movement member, a movement restricting member, and a second moving member. The medium guide member is movable between a first guide position, in which the medium guide member guides a medium toward a receiving member on which the medium is loaded, and a second guide position, in which the medium guide member guides the medium from the receiving member into the device. The driving source moves the medium guide member. The first movement member moves the medium guide member in accordance with an operation of the driving source. The movement restricting member is movable together with the medium guide member. The second moving member is movable between a first position, in which the second moving member is located close to the movement restricting member to restrict the medium guide member from moving from the second guide position to the first guide position, and a second position, in which the second moving member is spaced apart from the movement restricting member to allow the medium guide member to move to the first guide position. The second moving member moves from the first position to the second position when the medium guide member moves toward the first guide position in response to an operation of the driving source.

17 Claims, 13 Drawing Sheets

(58) Field of Classification Search
CPC ..... B65H 2404/632; B65H 2404/65; B65H 2404/74; B65H 2404/741; B65H 2404/7414; B65H 2601/11; B65H 2601/111
See application file for complete search history.

(56) References Cited

U.S. PATENT DOCUMENTS

| | | | | |
|---|---|---|---|---|
| 2018/0201459 | A1* | 7/2018 | Yamaguchi | B65H 7/14 |
| 2020/0102171 | A1* | 4/2020 | Ishifune | B65H 5/06 |

* cited by examiner

MEDIUM TRANSPORT DEVICE AND IMAGE FORMING APPARATUS

CROSS-REFERENCE TO RELATED APPLICATIONS

This application is based on and claims priority under 35 USC 119 from Japanese Patent Application No. 2018-183480 filed Sep. 28, 2018.

BACKGROUND

(i) Technical Field

The present disclosure relates to a medium transport device and an image forming apparatus.

(ii) Related Art

Japanese Patent No. 5479984 ([0033] to [0035] and FIGS. 4 and 5) describes a known technology relating to an image forming apparatus, such as a copying machine, a printer, or a FAX machine, including a switching device for switching the direction in which media are transported.

Japanese Patent No. 5479984 describes a structure that operates a branch member (220), which switches the direction in which sheets are transported, using a solenoid mechanism (30). In Japanese Patent No. 5479984, a buffer pad (241) and a resin sheet (251) are disposed on a sheet transport path to reduce the impulsive tone caused by transporting sheets with high speed.

SUMMARY

Aspects of non-limiting embodiments of the present disclosure relate to a measure to reduce erroneous guide of media compared to the case where a guide member that guides media are held in a predetermined position with a spring.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium transport device that includes a medium guide member, a driving source, a first movement member, a movement restricting member, and a second moving member. The medium guide member is movable between a first guide position, in which the medium guide member guides a medium toward a receiving member on which the medium is loaded, and a second guide position, in which the medium guide member guides the medium from the receiving member into the device. The driving source moves the medium guide member. The first movement member moves the medium guide member in accordance with an operation of the driving source. The movement restricting member is movable together with the medium guide member. The second moving member is movable between a first position, in which the second moving member is located close to the movement restricting member to restrict the medium guide member from moving from the second guide position to the first guide position, and a second position, in which the second moving member is spaced apart from the movement restricting member to allow the medium guide member to move to the first guide position. The second moving member moves from the first position to the second position when the medium guide member moves toward the first guide position in response to an operation of the driving source.

BRIEF DESCRIPTION OF THE DRAWINGS

Exemplary embodiments of the present disclosure will be described in detail based on the following figures, wherein:

FIG. 8A illustrates the gate in the first gate position, and FIG. 8B illustrates the gate in the second gate position;

FIG. 9A illustrates a positioning member in a first gate position, and FIG. 9B illustrates the positional relationship between the gate and a downstream portion of a fixing device in the state illustrated in FIG. 9A;

FIG. 10A illustrates the positioning member while a cover is opened, and FIG. 10B illustrates the positional relationship between the gate and a downstream portion of a fixing device in the state illustrated in FIG. 10A;

DETAILED DESCRIPTION

With reference to the drawings, specific examples (referred to as examples, below) of exemplary embodiments of the present disclosure will be described. The present disclosure is not limited to the following examples.

For easy understanding of the following description, throughout the drawings, an X axis direction denotes the front-rear direction, a Y axis direction denotes the lateral direction, and a Z axis direction denotes the vertical direction. The directions or sides denoted with arrows X, −X, Y, −Y, Z, and −Z are respectively referred to as forward, rearward, rightward, leftward, upward, and downward, or a front side, a rear side, a right side, a left side, an upper side, and a lower side.

Throughout the drawings, an encircled dot denotes an arrow directing from the back to the front of the sheet, and an encircled cross denotes an arrow directing from the front to the back of the sheet.

In the description with reference to the drawings, components other than those needed for the description are appropriately omitted for ease of understanding.

EXAMPLE 1

Figure 1:
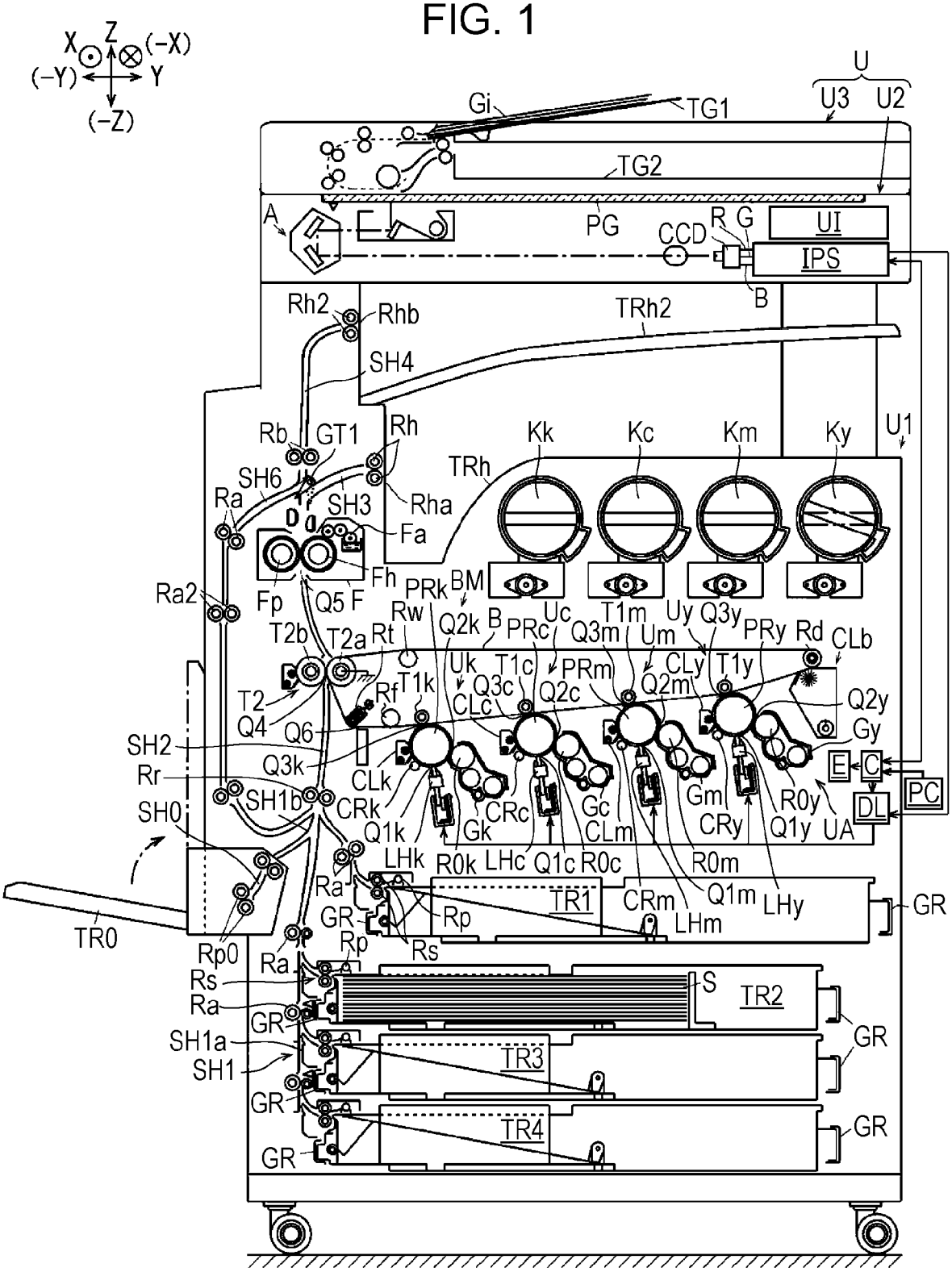
FIG. 1 illustrates the entirety of an image forming apparatus according to an example 1.

FIG. 1 illustrates the entirety of an image forming apparatus according to an example 1.

In FIG. 1, a copying machine U, which is an example of an image forming apparatus according to an example 1 of the present disclosure, includes a printer unit U1, which is an example of a recording unit and an example of an image recording device. The printer unit U1 supports, on its upper side, a scanner unit U2, which is an example of a reading unit and an example of an image reading device. The scanner unit U2 supports, on its upper side, an auto-feeder U3, which is an example of a document transporting device.

The auto-feeder U3 includes, at an upper portion, a document tray TG1, which is an example of a medium accommodating member. The document tray TG1 is capable of accommodating a stack of multiple documents Gi that are to be copied. A document output tray TG2, which is an example of a document discharge portion, is disposed below the document tray TG1. Document transport rollers U3*b* are disposed along a document transport path U3*a* connecting the document tray TG1 and the document output tray TG2.

On the upper surface of the scanner unit U2, a platen glass PG, which is an example of a transparent document table, is disposed. The scanner unit U2 according to the example 1 includes a reading unit U2*a*, which is an example of the reading unit, under the platen glass PG. The reading unit U2*a* according to the example 1 is supported to be movable in the lateral direction, which is an example of a sub-scanning direction, along the lower surface of the platen glass PG. The reading unit U2*a* is stationary in a normal state in an initial position drawn with a solid line in FIG. 1. The reading unit U2*a* is electrically connected to an image processor GS.

Light reflected off a document transported over the original read surface PG by an original transporting device or a document manually placed on the original read surface PG is converted into electric signals of red R, green G, and blue B by a solid-state image sensor CCD via an exposure optical system A.

In a first multifunctional device, an information converting unit IPS converts the R, G, and B electric signals input from a solid-state image sensor CCD and print information transmitted from a client personal computer PC into image information for black K, yellow Y, magenta M, and cyan C, and temporarily stores the image information. The information converting unit IPS outputs the image information to a write circuit DL as image information for forming latent images at predetermined timing.

When the document image is a single-color image or a monochrome image, image information for only black K is input to the write circuit DL.

Figure 2:
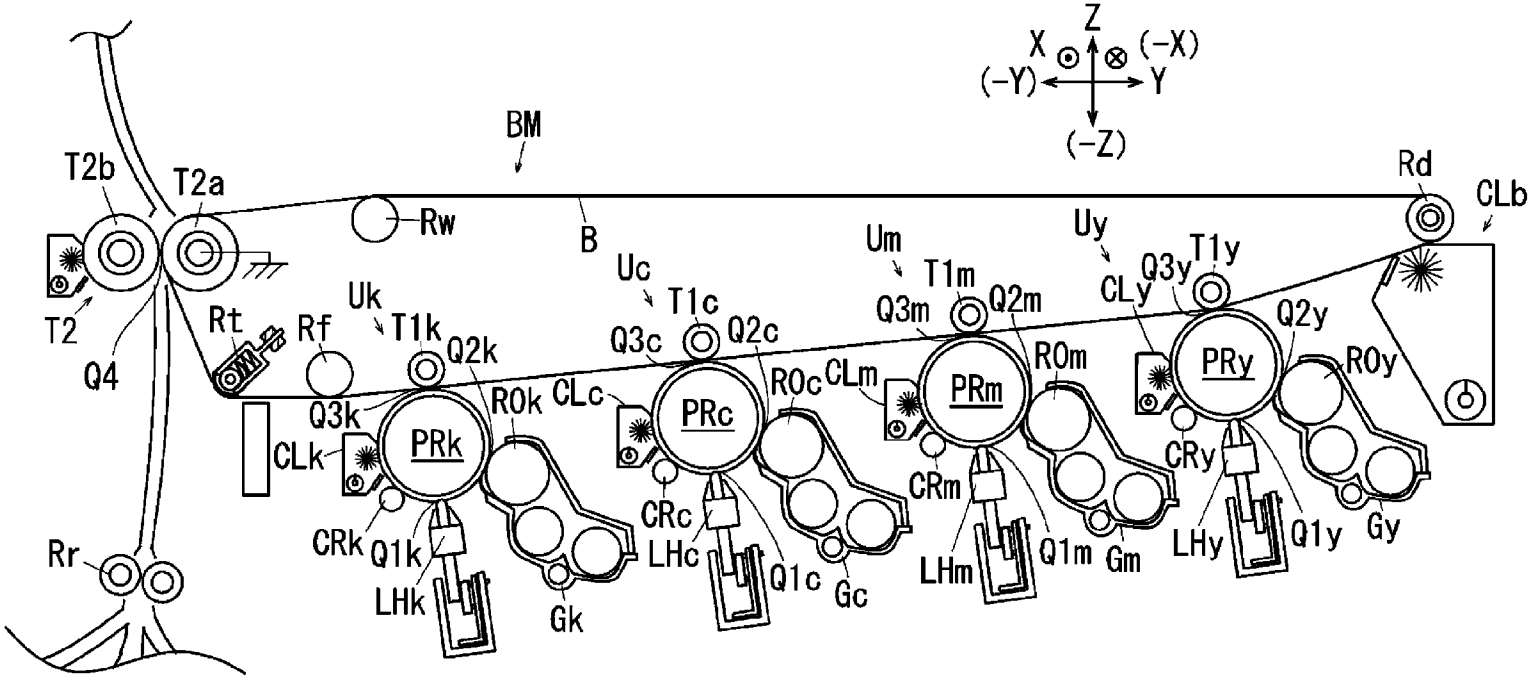
FIG. 2 illustrates a related portion of an image recording portion according to the example 1.

FIG. 2 illustrates a related portion of an image recording unit according to the example 1.

The image processor GS is electrically connected to the write circuit DL of the printer unit U1. The write circuit DL is electrically connected to an exposure devices LHy, LHm, LHc, and LHk, which are an example of a latent image forming member.

The exposure devices LHy to LHk according to the example 1 are formed from, for example, LED heads each including multiple LEDs arranged in the main scanning direction. The exposure devices LHy to LHk are capable of outputting write light, corresponding to the colors Y, M, C, and K in response to signals input from the write circuit DL.

The write circuit DL or a power circuit E has write timing or power feed timing controlled in accordance with control signals from a controller C, which is an example of a controller.

In FIG. 1, photoconductors PRy, PRm, PRc, and PRk, which are an example of an image carrier, are disposed above the exposure devices LHy to LHk. In FIGS. 1 and 2, the areas of the photoconductors PRy to PRk respectively irradiated with the write light constitute write areas Q1*y*, Q1*m*, Q1*c*, and Q1*k*.

Upstream of the write areas Q1*y* to Q1*k* in the rotation direction of the photoconductors PRy, PRm, PRc, and PRk, charging rollers CRy, CRm, CRc, and CRk, which are an example of a charging member, are disposed. The charging rollers CRy to CRk according to the example 1 are supported to be driven to rotate in contact with the photoconductors PRy to PRk.

Downstream of the write areas Q1*y* to Q1*k* in the rotation direction of the photoconductors PRy to PRk, developing devices Gy, Gm, Gc, and Gk, which are an example of a developing member, are disposed. The areas over which the photoconductors PRy to PRk and the developing devices Gy to Gk face each other constitute development areas Q2*y*, Q2*m*, Q2*c*, and Q2*k*.

Downstream of the developing devices Gy to Gk in the rotation direction of the photoconductors PRy to PRk, first transfer rollers T1*y*, T1*m*, T1*c*, and T1*k*, which are an example of a first transfer member, are disposed. The areas over which the photoconductors PRy to PRk and the first transfer rollers T1*y* to T1*k* face each other constitute first transfer areas Q3*y*, Q3*m*, Q3*c*, and Q3*k*.

Downstream of the first transfer rollers T1*y* to T1*k* in the rotation direction of the photoconductors PRy to PRk, photoconductor cleaners CLy, CLm, CLc, and CLk, which are an example of a cleaner, are disposed.

The photoconductor PRy, the charging roller CRy, the exposure device LHy, the developing device Gy, the first transfer roller T1*y*, and the photoconductor cleaner CLy for the color Y constitute an image forming unit Uy for the color Y, which is an example of a visible image forming member for the color Y according to the example 1 that forms toner images for the color Y. Similarly, the photoconductors PRm, PRc, and PRk, the charging rollers CRm, CRc, and CRk, the exposure devices LHm, LHc, and LHk, the developing devices Gm, Gc, and Gk, the first transfer rollers T1*m*, T1*c*, and T1*k*, and the photoconductor cleaners CLm, CLc, and CLk constitute image forming units Um, Uc, and Uk for the colors M, C, and K.

Above the photoconductors PRy to PRk, a belt module BM, which is an example of an intermediate transfer device, is disposed. The belt module BM is an example of an image carrier, and includes an intermediate transfer belt B, which is an example of an intermediate transfer member. The intermediate transfer belt B is formed from an endless belt member.

The intermediate transfer belt B according to the example 1 is rotatably supported by a tension roller Rt, which is an example of a tension member, a walking roller Rw, which is an example of an imbalance correcting member, an idler roller Rf, which is an example of a driven member, a backup roller T2*a*, which is an example of a member opposing the second transfer area, the first transfer rollers T1*y*, T1*m*, T1*c*, and T1*k*, and a driving roller Rd, which is an example of a driving member. In the example 1, the intermediate transfer belt B rotates when the driving roller Rd receives a driving force.

At the position opposing the backup roller T2*a* across the intermediate transfer belt B, a second transfer roller T2*b*, which is an example of a second transfer member, is disposed. The backup roller T2*a*, the second transfer roller T2*b*, and other components constitute a second transfer device T2 according to the example 1, which is an example of a transfer device. The area over which the second transfer roller T2*b* and the intermediate transfer belt B come into contact with each other forms a second transfer area Q4.

Downstream of the second transfer area Q4 in the rotation direction of the intermediate transfer belt B, a belt cleaner CLb, which is an example of a device for cleaning an intermediate transfer body, is disposed.

The first transfer rollers T1*y* to T1*k*, the intermediate transfer belt B, the second transfer device T2, and other components constitute a transfer device T1+T2+B according to the example 1, which is an example of a transfer member. The image forming units Uy to Uk and the transfer device T1+T2+B constitute an image recording unit Uy+Um+Uc+Uk+T1+T2+B according to the example 1.

In FIG. 1, below the image forming units Uy to Uk, four pairs of left and right guide rails GR, which are an example of a guide member, are disposed on four levels. Each guide rail GR supports a corresponding one of sheet feed trays TR1 to TR4, which are an example of a medium accommodating member, while allowing the sheet feed tray to be inserted thereinto or removed therefrom in the front-rear direction. The sheet feed trays TR1 to TR4 accommodate recording sheets S, which are an example of a medium.

On the upper left of each of the sheet feed trays TR1 to TR4, a pickup roller Rp, which is an example of a pickup member, is disposed. Downstream of each pickup roller Rp in the direction in which the recording sheets S are transported, separation rollers Rs, which are an example of a separation member, are disposed. Downstream of the separation rollers Rs in the direction in which the recording sheets S are transported, a sheet feed path SH1, which is an example of a medium transport path, extends upward. On the sheet feed path SH1, multiple transport rollers Ra, which are an example of a transport member, are disposed.

On the lower left of the copying machine U, a manual tray TR0, which is an example of a medium accommodating member, is disposed. On the upper right of the manual tray TR0, pickup rollers Rp0 are disposed, and a manual feed path SH0 extends from the pickup rollers Rp0. The manual feed path SH0 is merged with the sheet feed path SH1.

Registration rollers Rr, which are an example of a transport timing adjusting member, are disposed on the sheet feed path SH1 upstream of the second transfer area Q4. A transport path SH2 extends from the registration rollers Rr to the second transfer area Q4.

Downstream of the second transfer area Q4 in the direction in which the recording sheets S are transported, a fixing device F, which is an example of a fixing member, is disposed. The fixing device F includes a heating roller Fh, which is an example of a heating fixing member, and a pressing roller Fp, which is an example of a pressing fixing member. The area over which the heating roller Fh and the pressing roller Fp come into contact with each other constitutes a fixing area Q5.

On the upper surface of the printer unit U1, a lower paper output tray TRh, which is an example of a medium output portion, is disposed. A paper output path SH3, which is an example of a medium transport member, extends toward the lower paper output tray TRh above the fixing device F. At the downstream end of the paper output path SH3, output rollers Rh, which are an example of a medium transport member, are disposed.

Above the lower paper output tray TRh, an upper paper output tray TRh2, which is an example of a medium output portion, is disposed. Above the fixing device F, an upper transport path SH4, which diverges from the paper output path SH3, extends toward the upper paper output tray TRh2.

On the upper transport path SH4, reversing rollers Rb rotatable forward and rearward, which are an example of a medium transport member, are disposed. Above the point of divergence between the paper output path SH3 and the upper transport path SH4, a reverse path SH6, which is an example of a medium transport path, diverges downward to the left from the upper transport path SH4. A gate GT1, which is an example of a switching member, is disposed across the point of divergence between the paper output path SH3 and the upper transport path SH4 and the point of divergence between the upper transport path SH4 and the reverse path SH6. The gate GT1 is supported to be switchable between a first guide position (second position), at which it guides a recording sheet S from the fixing device F toward the lower paper output tray TRh and guides a recording sheet S from the upper transport path SH4 to the reverse path SH6, and a second guide position (first position), at which it guides a recording sheet S from the fixing device F to the upper transport path SH4.

On the reverse path SH6, multiple transport rollers Ra, which are an example of a medium transport member, are disposed. The reverse path SH6 has its downstream end merged to the sheet feed path SH1 at a portion upstream of the registration rollers Rr.

Description of Image Forming Operation

When an operator manually places a document Gi on the platen glass PG of the copying machine U according to the example 1 having the above structure for photocopying, the reading unit U2*a* moves in the lateral direction from the initial position to scan the document Gi on the platen glass PG while exposing the document Gi to light. When the auto-feeder U3 is used to automatically transport the documents Gi for photocopying, the reading unit U2*a* moves from the initial position to a document read position, indicated with a broken line in FIG. 1, and remains stationary. Thereafter, the multiple documents Gi accommodated in the document tray TG1 are sequentially transported to the document read position on the platen glass PG, and then passes the document read position to be discharged onto the document output tray TG2. The documents Gi that sequentially pass the read position on the platen glass PG are exposed to light and scanned by the stationary reading unit U2*a*. Light reflected off the documents Gi is received by the reading unit U2*a*. The reading unit U2*a* converts the received light reflected off the documents Gi into electric signals. To perform double-sided reading of a document Gi, a read sensor U3*d* also reads the document Gi.

The image processor GS receives electric signals output from the reading unit U2*a*. The image processor GS converts the electric signals of images of the colors R, G, and B read by the reading unit U2*a* into image information of yellow Y, magenta M, cyan C, and black K for latent image formation. The image processor GS outputs the converted image information to the write circuit DL of the printer unit U1. The image processor GS outputs the image information for only black K to the write circuit DL when an image is a single-color image, or a monochrome image.

The write circuit DL outputs control signals corresponding to the input image information to the exposure devices LHy to LHk. The exposure devices LHy to LHk output the write light corresponding to the control signals.

The photoconductors PRy to PRk rotate in response to the start of image formation. The charging rollers CRy to CRk receive a charging voltage from the power circuit E. Thus, the photoconductors PRy to PRk have their surfaces electrically charged by the charging rollers CRy to CRk. Electrostatic latent images are formed in the write areas Q1*y* to Q1*k* on the surfaces of the electrically charged photoconductors PRy to PRk with the laser beams Ly to Lk. The electrostatic latent images on the photoconductors PRy to PRk are developed into toner images, which are an example of a visible image, by the developing devices Gy, Gm, Gc, and Gk in the development areas Q2*y* to Q2*k*.

The developed toner images are transported to the first transfer areas Q3*y*, Q3*m*, Q3*c*, and Q3*k*, at which they come into contact with the intermediate transfer belt B, which is an example of an intermediate transfer body. In the first transfer areas Q3*y*, Q3*m*, Q3*c*, and Q3*k*, the first transfer rollers T1*y* to T1*k* receive, from the power circuit E, a first transfer voltage having a polarity opposite to the polarity with which the toner is charged. Thus, the toner images on the photoconductors PRy to PRk are transferred to the intermediate transfer belt B by the first transfer rollers T1*y* to T1*k*. To form a multi-color toner image, a toner image on the downstream side is transferred to the intermediate transfer belt B to be superposed on a toner image that has been transferred to the intermediate transfer belt B in the upstream first transfer area.

Remnants or deposits left on the photoconductors PRy to PRk after a first transfer are respectively removed by the photoconductor cleaners CLy to CLk. The surfaces of the cleaned photoconductors PRy to PRk are respectively electrically recharged by the charging rollers CRy to CRk.

Single-color or multi-color toner images transferred onto the intermediate transfer belt B by the first transfer rollers T1*y* to T1*k* in the first transfer areas Q3*y* to Q3*k* are transported to the second transfer area Q4.

Recording sheets S on which images are to be recorded are picked up by the pickup roller Rp of an appropriate one of the sheet feed trays TR1 to TR4. The recording sheets S picked up by the pickup roller Rp while being stacked together are separated one from another by the separation rollers Rs. The recording sheets S separated by the separation rollers Rs are transported along the sheet feed path SH1 by the transport rollers Ra. The recording sheets S transported along the sheet feed path SH1 are fed to the registration rollers Rr. The recording sheets S placed on the manual tray TR0 are also fed to the sheet feed path SH1 through the manual feed path SH0 by the pickup rollers Rp0.

The registration rollers Rr transport a recording sheet S to the second transfer area Q4 at the timing when a toner image formed on the intermediate transfer belt B is transported to the second transfer area Q4. The second transfer roller T2*b* receives, from the power circuit E, a second transfer voltage having a polarity opposite to the polarity with which toner is charged. Thus, the toner image on the intermediate transfer belt B is transferred to the recording sheet S from the intermediate transfer belt B.

After the second transfer, the intermediate transfer belt B is cleaned by the belt cleaner CLb to remove deposits or other matters adhering to the surface.

The recording sheet S to which the toner image has been second-transferred is heated to have the toner image fixed while passing the fixing area Q5.

When the recording sheet S having an image fixed thereto is discharged to the lower paper output tray TRh, the gate GT1 is moved to the first guide position. The recording sheet S discharged from the fixing device F is thus transported along the paper output path SH3. The recording sheet S transported along the paper output path SH3 is discharged to the lower paper output tray TRh by the output rollers Rh.

When the recording sheet S is to be discharged to the upper paper output tray TRh2, the gate GT1 is moved to the second guide position to allow the recording sheet S to be discharged to the upper paper output tray TRh2.

When the recording sheet S is to be subjected to double-side printing, the gate GT1 is moved to the second guide position. When the recording sheet S has its trailing end passing the gate GT1, the gate GT1 is moved to the first guide position, and the reversing rollers Rb rotate rearward. Thus, the recording sheet S is guided to the gate GT1, and transported to the reverse path SH6.

Description of Gate Movement Mechanism

Figure 3:
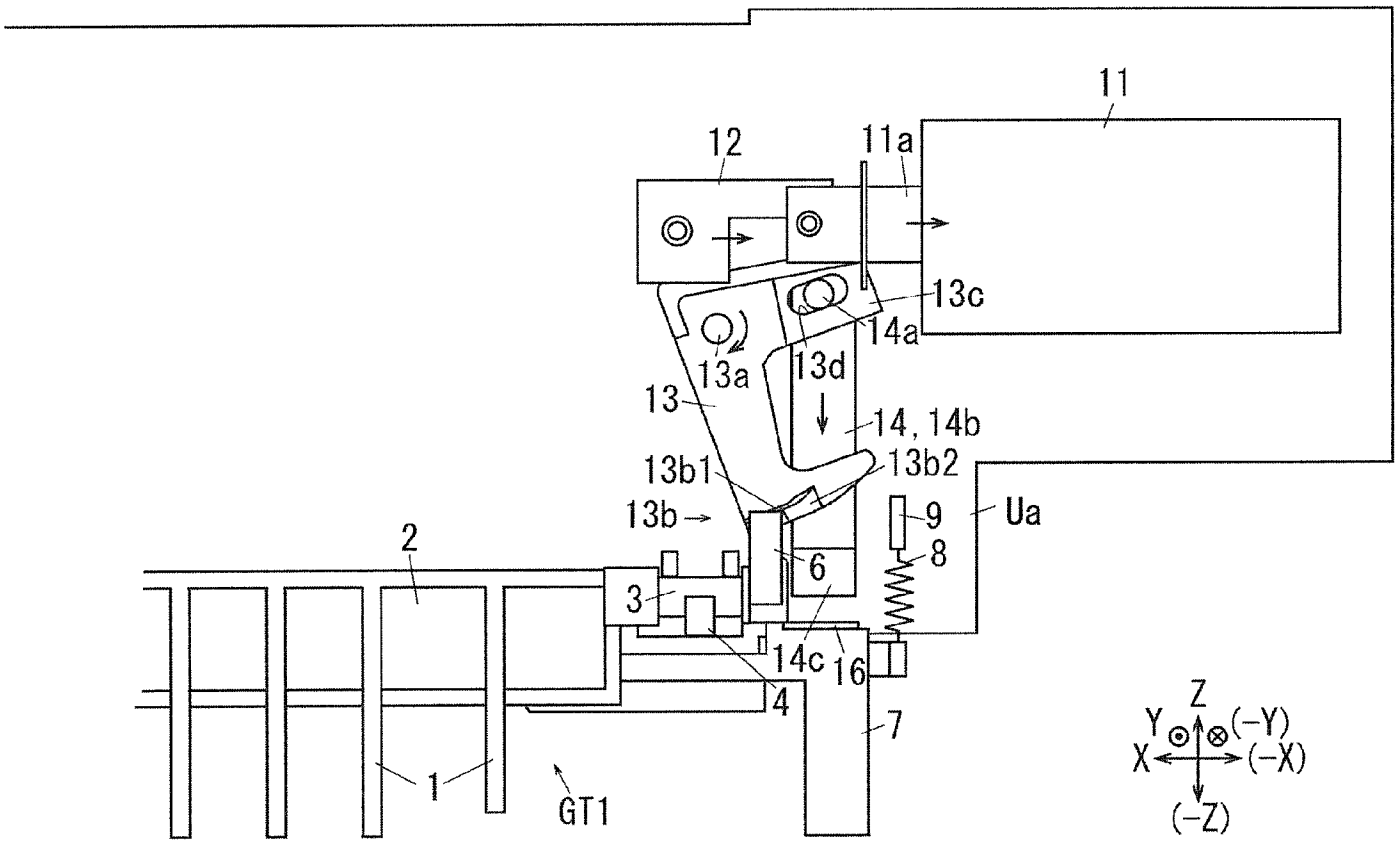
FIG. 3 illustrates a gate driving mechanism according to the example 1, in the state where a second moving member is moved to a first position.

FIG. 3 illustrates a gate driving mechanism according to the example 1, in the state where a second moving member is moved to a first position.

Figure 4:
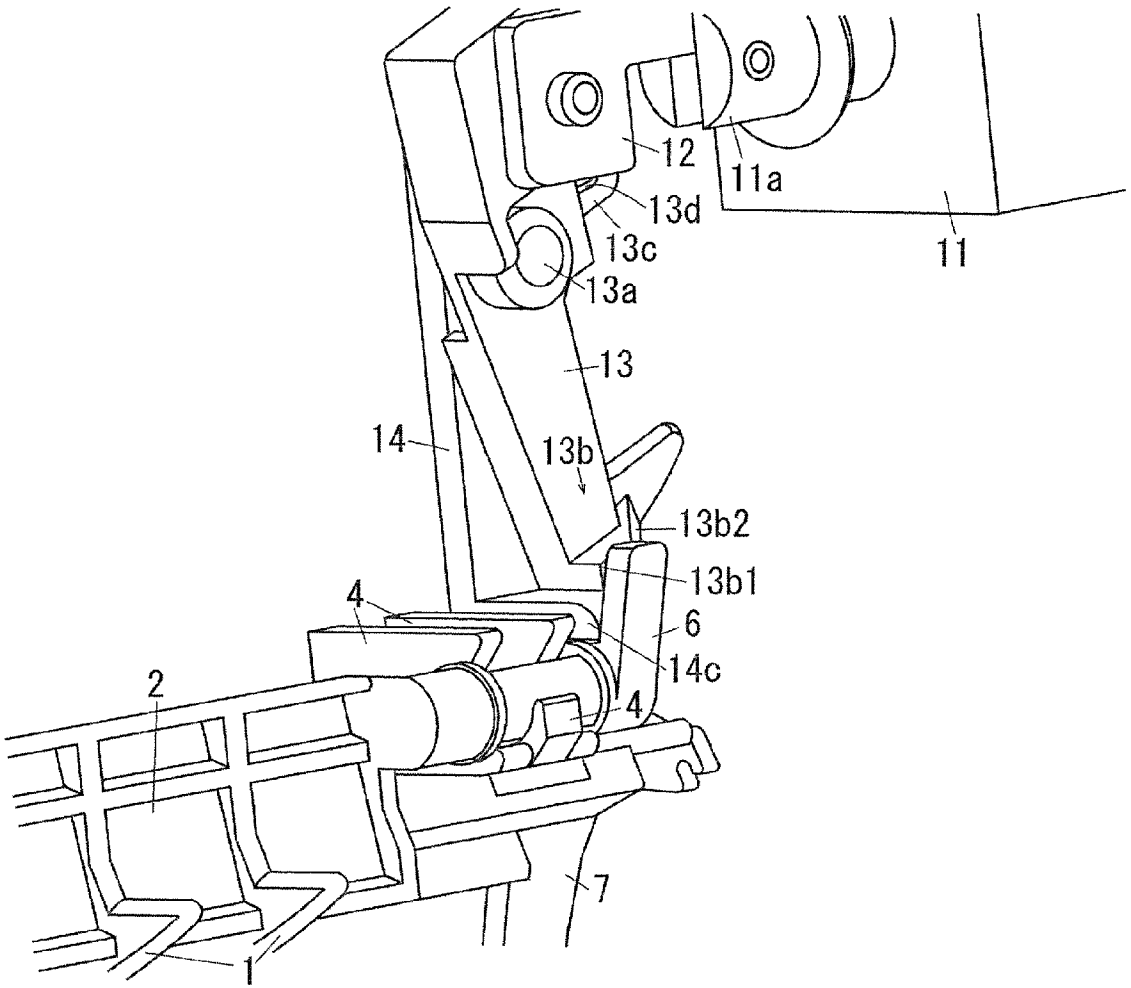
FIG. 4 is a perspective view of the driving mechanism in the state illustrated in FIG. 3.

FIG. 4 is a perspective view of the driving mechanism in the state illustrated in FIG. 3.

Figure 5:
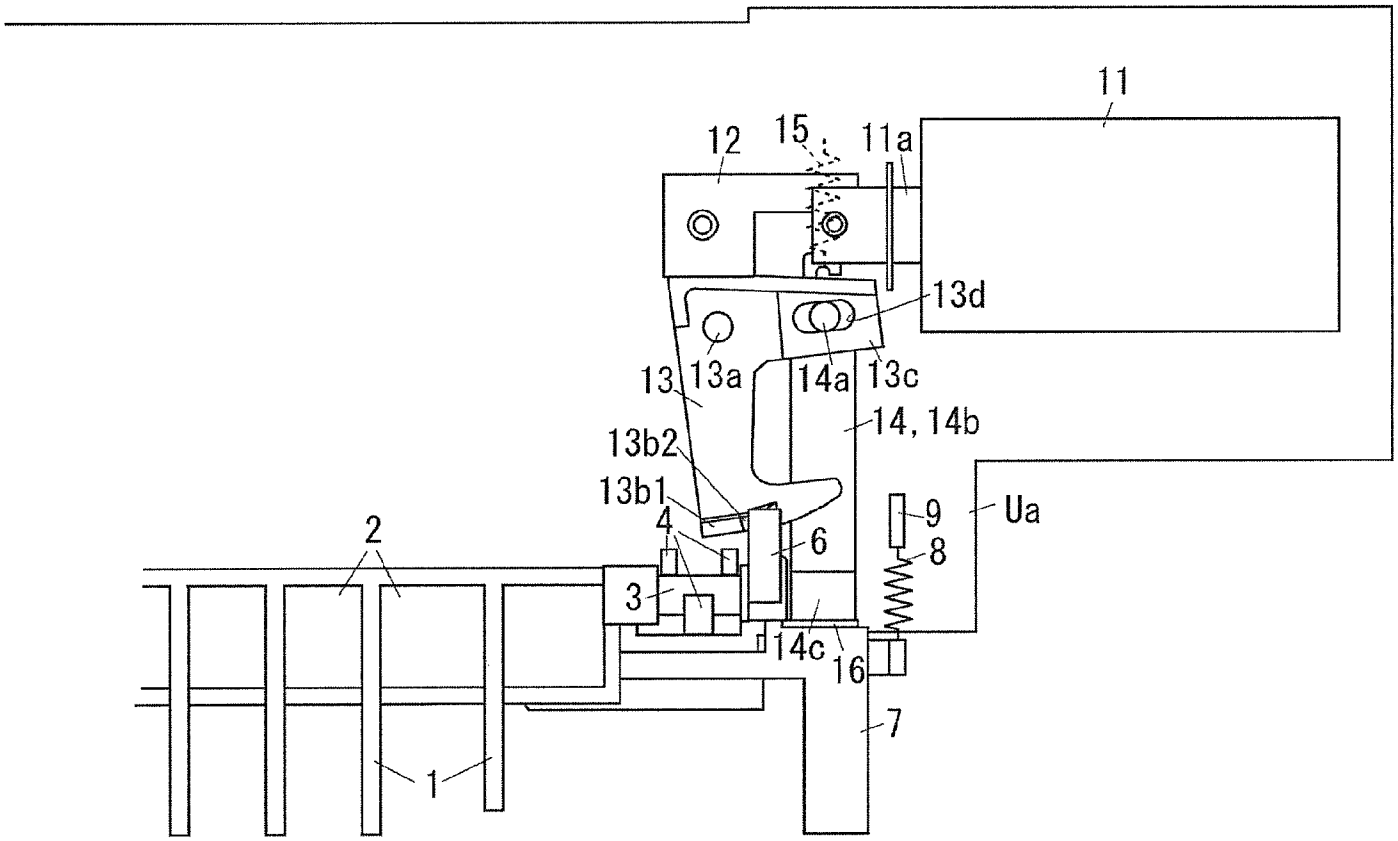
FIG. 5 illustrates the gate driving mechanism according to the example 1, in the state where the second moving member is moving from the first position to a second position.

FIG. 5 illustrates the gate driving mechanism according to the example 1, in the state where the second moving member is moving from the first position to a second position.

Figure 6:
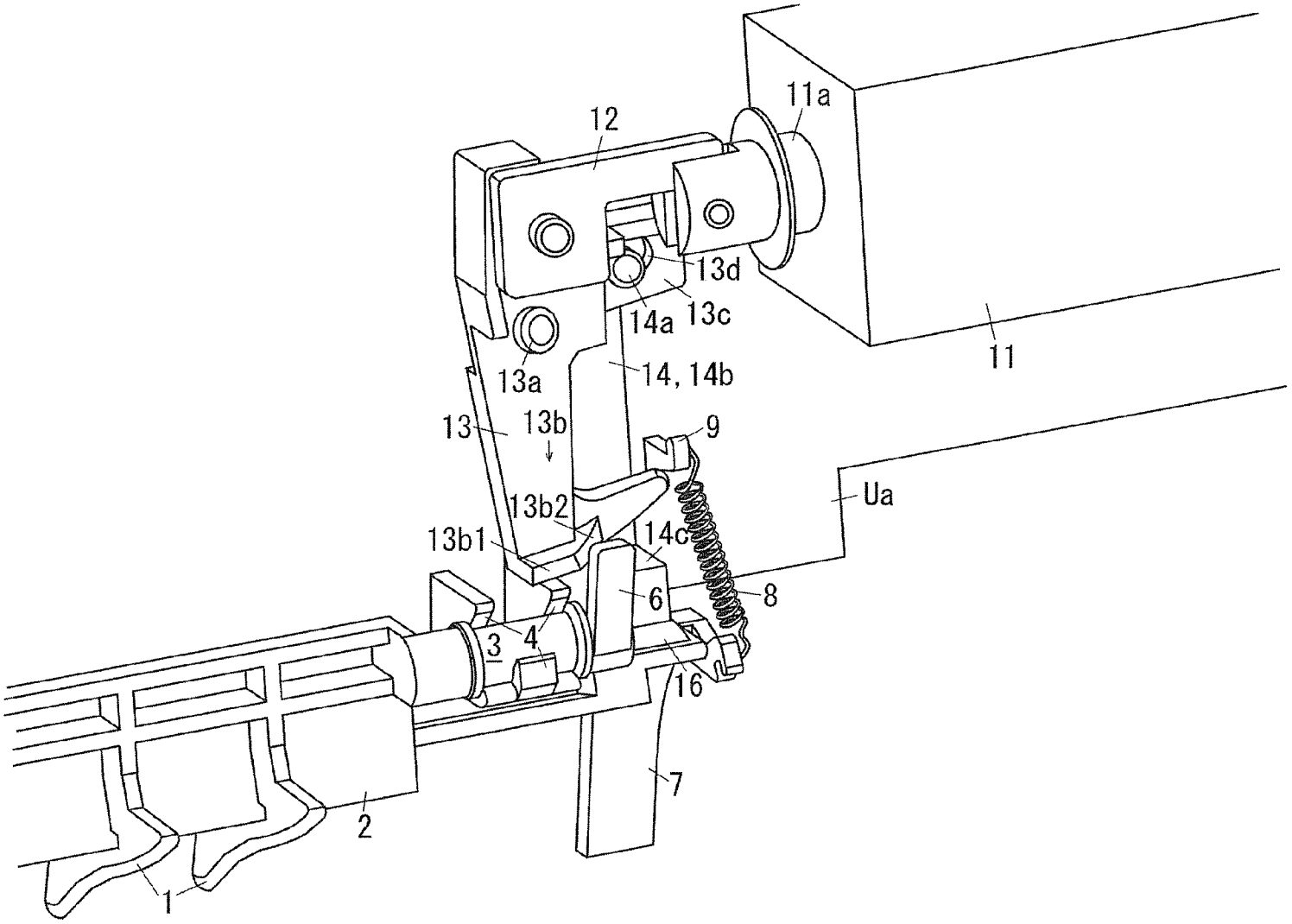
FIG. 6 is a perspective view of the driving mechanism in the state illustrated in FIG. 5.

FIG. 6 is a perspective view of the driving mechanism in the state illustrated in FIG. 5.

Figure 7:
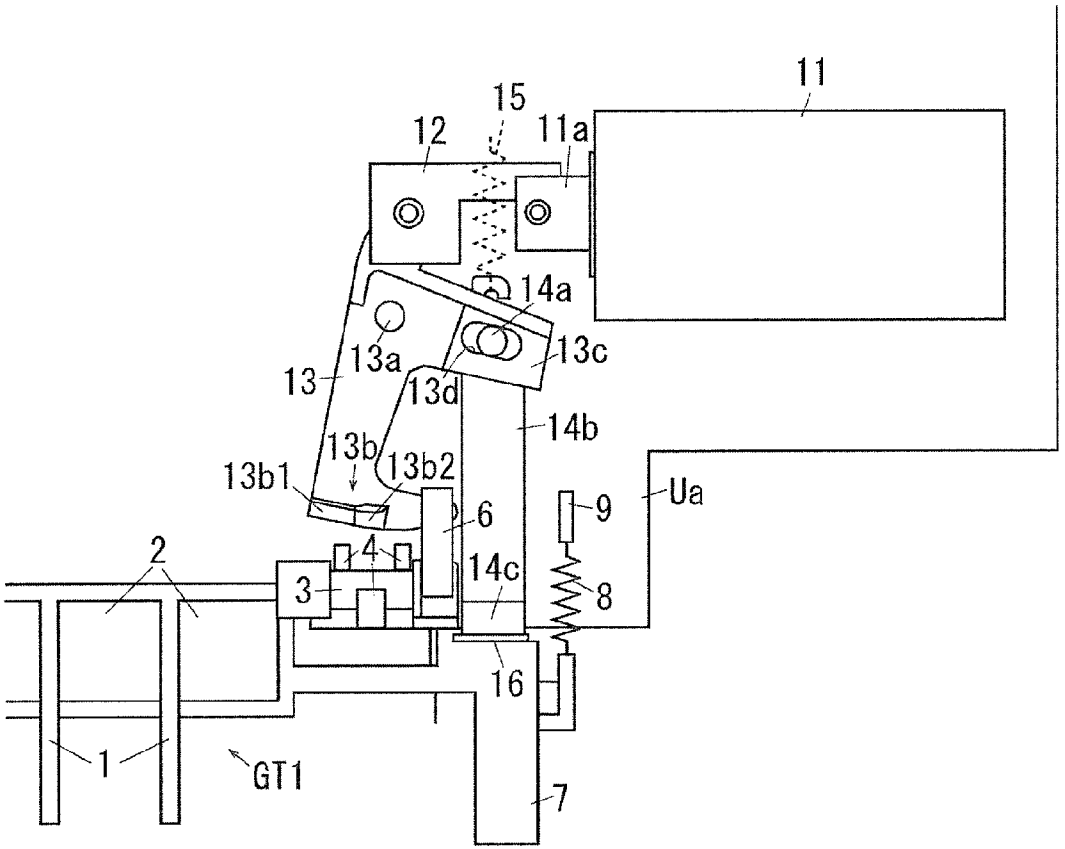
FIG. 7 illustrates the gate driving mechanism according to the example 1, in the state where the second moving member is moved to the second position.

FIG. 7 illustrates the gate driving mechanism according to the example 1, in the state where the second moving member is moved to the second position.

Figure 8B:
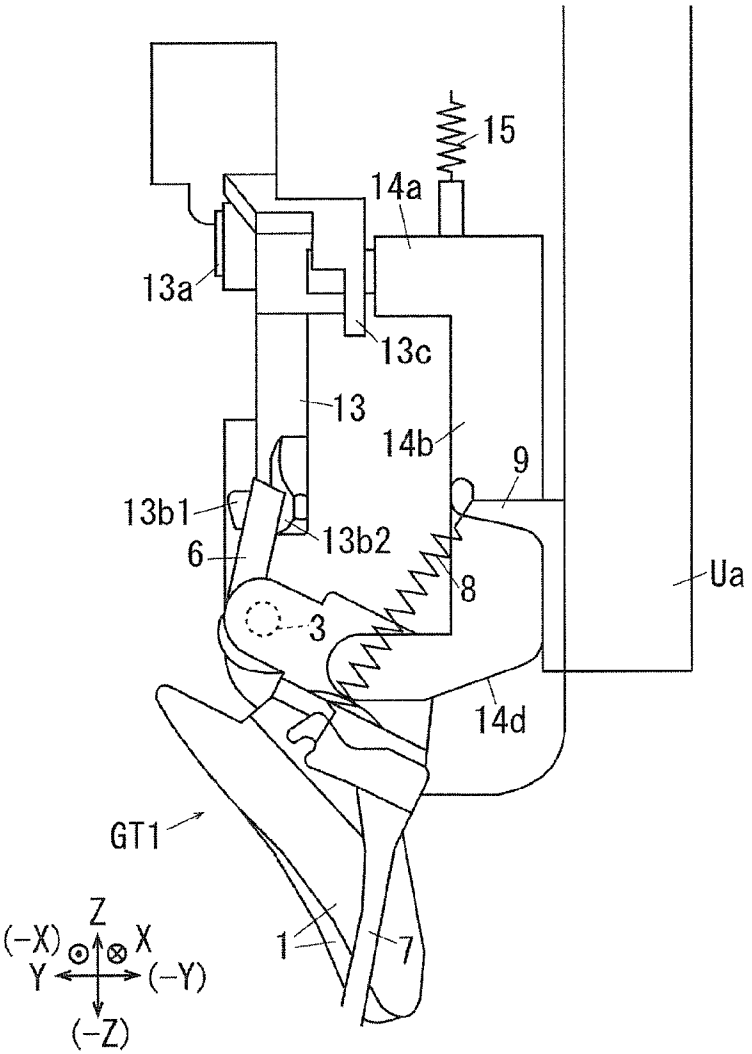
FIGS. 8A and 8B illustrate the gate according to the example 1, where
Figure 8A:
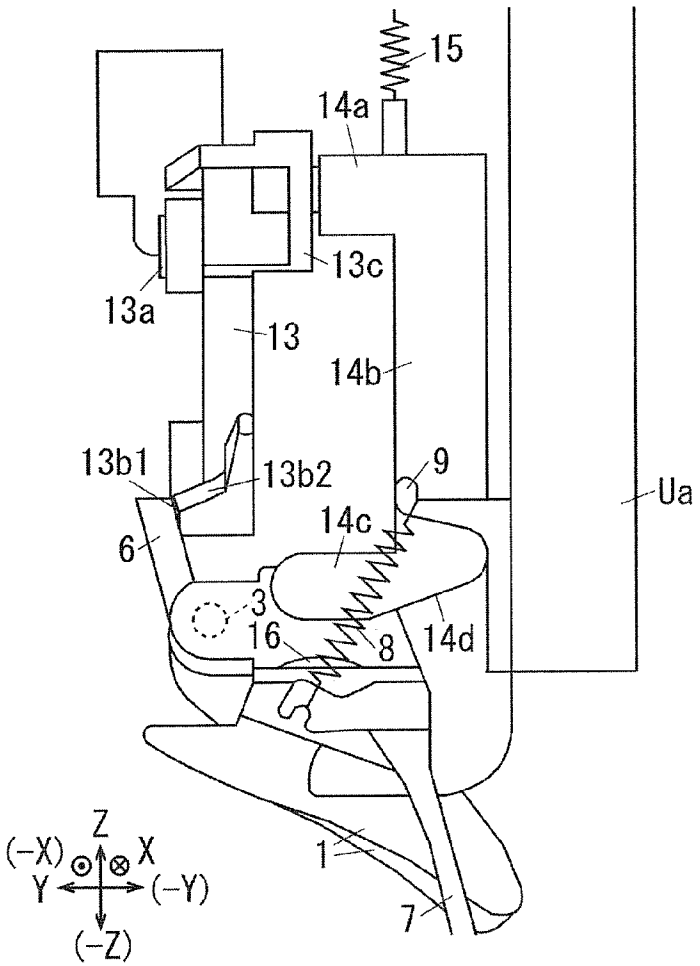

FIGS. 8A and 8B illustrate the gate according to the example 1, where FIG. 8A illustrates the gate in the first gate position, and FIG. 8B illustrates the gate in the second gate position.

In FIGS. 3 to 8B, the gate GT1 according to the example 1 includes multiple plate-shaped gate bodies 1 arranged at intervals in the width direction of the recording sheet S. The gate bodies 1 are coupled together with a coupling portion 2, extending in the width direction of the recording sheet S. The gate bodies 1 thus form a comb shape. Shafts 3 are disposed at the outer ends of the coupling portion 2.

A rear shaft 3*a* is rotatably supported by a shaft bearing 4 of a frame Ua.

At the rear of the rear (first end) shaft 3*a*, a lock piece 6, which is an example of a movement restricting member, is disposed. The lock piece 6 according to the example 1 has a plate shape extending in the radial direction of the shaft 3.

At the rear end portion of the gate GT1, a positioning plate 7, which is an example of a positioned member, is disposed. The positioning plate 7 according to the example 1 has a plate shape extending downward.

To an end portion of the gate GT1 at the rear of the positioning plate 7, a first end of a gate spring 8, which is an example of a first urging member, is coupled. The gate spring 8 has the other end supported by a spring supporter 9 of the frame Ua. The gate spring 8 according to the example 1 exerts a force directing to move the gate GT1 to the first gate position (second guide position).

At the rear end portion of the frame Ua, a solenoid 11, which is an example of a driving source, is supported. The solenoid 11 includes a plunger 11*a*, which is an example of a retractable portion. The plunger 11*a* is capable of expanding beyond and contracting into the solenoid 11, and retracted into the solenoid 11 when the solenoid 11 is in operation (turned on).

At the tip end of the plunger 11*a*, a first link 12, which is a first connection member, is rotatably supported.

At the front end of the first link 12, an upper end of a second link 13, which is an example of a second moving member, is rotatably supported.

The second link 13 is rotatably supported by a rotation shaft 13*a* disposed on the frame Ua. Thus, the second link 13 is supported to be movable between the locked position illustrated in FIG. 3, which is an example of a first position, and an unlocked position illustrated in FIG. 6, which is an example of a second position.

At the left of the lower end of the second link 13, a locking portion 13*b*, which is an example of a restricting member, is disposed. The locking portion 13*b* protrudes rightward. At the front portion of the locking portion 13*b*, a lock surface 13*b*1, which is an example of a stop surface, extends in the front-rear direction. At the rear portion of the locking portion 13*b*, an inclined surface 13*b*2, which is inclined to the left as it extends rearward, is disposed.

The position, the dimensions, and the shape of the locking portion 13*b* according to the example 1 are determined so that the lock surface 13*b*1 faces or adjoins the lock piece 6 when the gate is in the first gate position illustrated in FIG. 3 and FIG. 4. The position and the shape of the locking portion 13*b* are determined so that the locking portion 13*b* is spaced apart from the lock piece 6, specifically, shifted from the lock piece 6 in the front-rear direction when the gate is in the second gate position illustrated in FIG. 7.

The second link 13 includes a coupling portion 13*c*, which extends rearward from the position of the rotation shaft 13*a*.

The coupling portion 13*c* has a long hole 13*d*, which extends in the front-rear direction.

An upper end portion 14*a* of a third link 14, which is an example of a first movement member, is coupled to the long hole 13*d*. The third link 14 is supported by the upper end portion 14*a* to be movable along the long hole 13*d* and rotatable. Thus, the third link 14 is coupled to the second link 13 via the long hole 13*d*.

In FIGS. 8A and 8B, the third link 14 includes a gate body 14*b*, which extends vertically. At the lower end of the gate body 14*b*, a press-down portion 14*c*, which extends rightward, is disposed as an example of a contact portion. On the lower surface of the press-down portion 14*c*, an inclined portion 14*d*, which is inclined upward as it extends leftward, is disposed.

To the upper end of the third link 14, the lower end of a return spring 15, which is an example of the second urging member, is coupled. The upper end of the return spring 15 is supported by a spring supporter of the frame Ua, which is not illustrated. The return spring 15 exerts a force of urging the third link 14 upward.

As illustrated in FIG. 3 and FIG. 8A, the third link 14 according to the example 1 is spaced apart from the gate GT1 when the gate GT1 is in the first gate position. As illustrated in FIG. 7 and FIG. 8B, when the solenoid 11 is turned on, the third link 14 comes into contact with a contacted surface 16 of the gate GT1 to press down the gate GT1. Thus, the gate GT1 rotates by being pressed by the third link 14 and moves to the second gate position.

The contacted surface 16 according to the example 1 is curved out upward. Compared to the one having a flat surface, the contacted surface 16 facilitates sliding with the third link 14 when in contact with the third link 14, and the frictional resistance at the contact, which serves as rotation resistance of the gate GT1, is reduced.

Figure 9B:
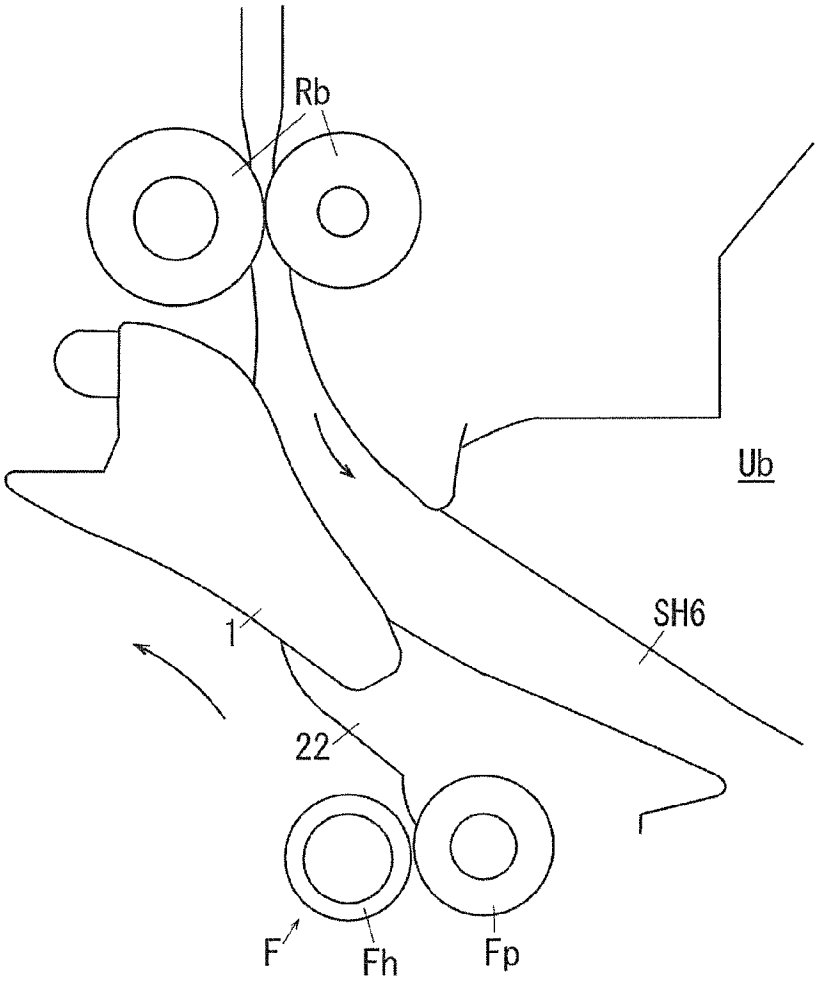
FIGS. 9A and 9B illustrate a gate positioning mechanism according to the example 1, where
Figure 9A:
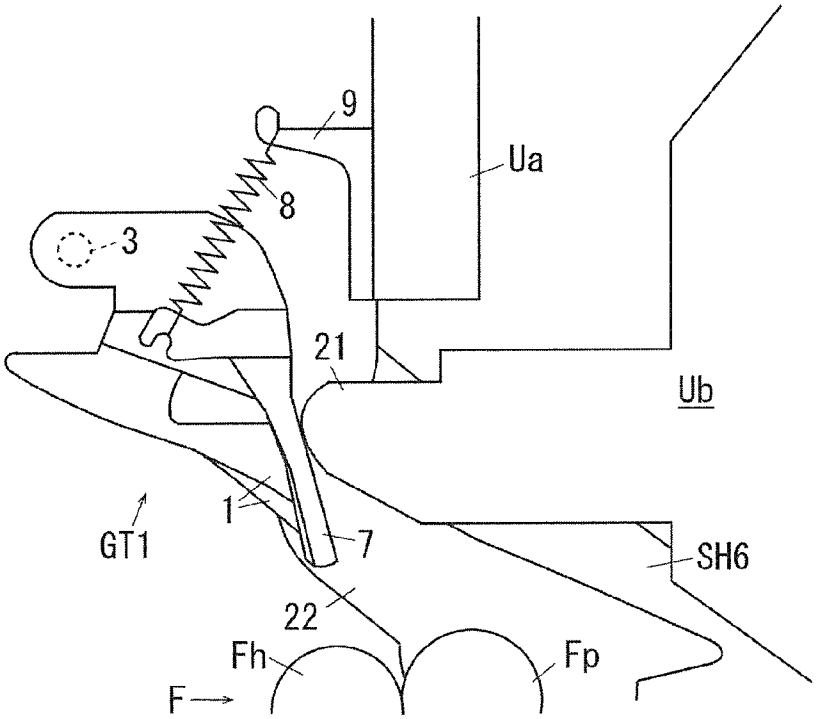

FIGS. 9A and 9B illustrate a gate positioning mechanism according to the example 1, where FIG. 9A illustrates a positioning member in a first gate position, and FIG. 9B illustrates the positional relationship between the gate and a downstream portion of a fixing device in the state illustrated in FIG. 9A.

In FIGS. 9A and 9B, the copying machine U according to the example 1 includes an open-close cover Ub, which is an example of an openable member, supported on the side surface of the copying machine U. The open-close cover Ub renders the reverse path SH6 open or closed when the reverse path SH6 has a paper jam. A stopblock 21, which is an example of a positioning member, is disposed on the open-close cover Ub according to the example 1. When the open-close cover Ub illustrated in FIG. 9A is closed, the gate GT1 is fixed in the first gate position with the positioning plate 7 coming into contact with the stopblock 21. Here, as illustrated in FIG. 9B, the comb-shaped gate bodies 1 and comb-shaped guide portions 22 on the downstream side of the fixing device F are alternately arranged in the front-rear direction. Specifically, as illustrated in FIG. 9B, when viewed in the front-rear direction (medium width direction), the gate bodies 1 and the guide portions 22 are arranged to overlap partially.

Figure 10B:
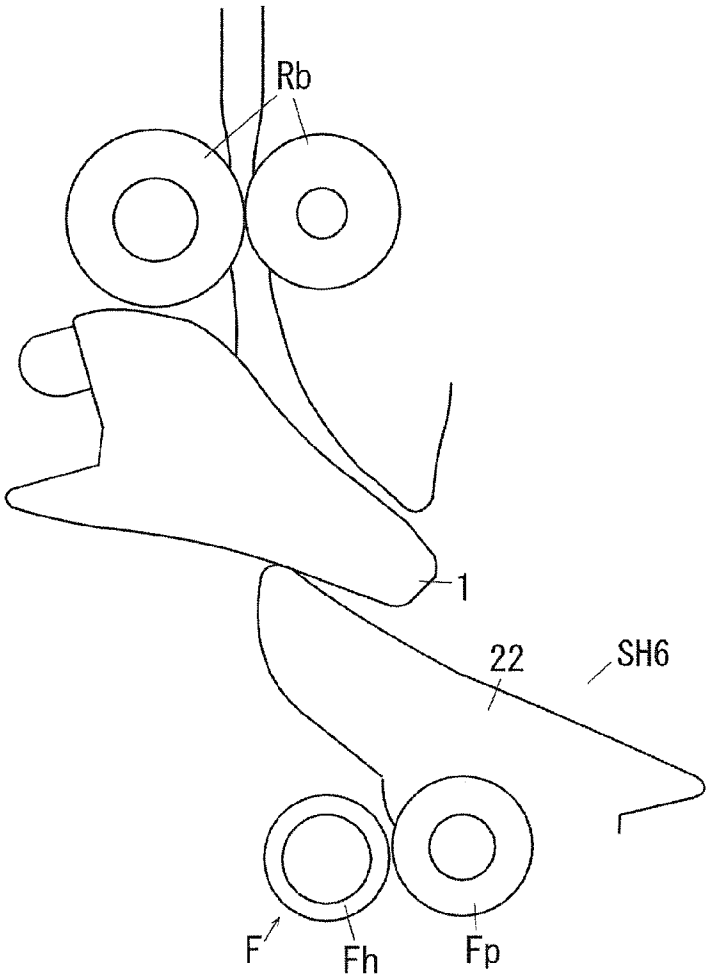
FIGS. 10A and 10B illustrate the gate positioning mechanism according to the example 1, where
Figure 10A:
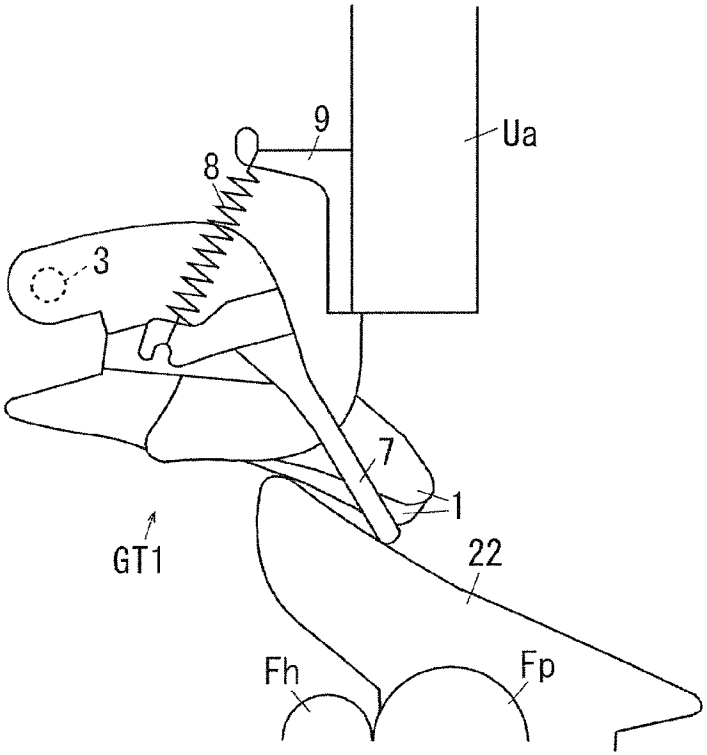

FIGS. 10A and 10B illustrate the gate positioning mechanism according to the example 1, where FIG. 10A illustrates the positioning member while the cover is opened, and FIG. 10B illustrates the positional relationship between the gate and a downstream portion of the fixing device in the state illustrated in FIG. 10A.

In FIGS. 10A and 10B, when the open-close cover Ub is opened, the stopblock 21 is spaced apart from the positioning plate 7. Thus, the gate GT1 rotates with the elastic force of the gate spring 8 to be in the state illustrated in FIG. 10A. In this state, the gate bodies 1 and the guide portions 22 are apart from each other. In this state, in the case of a paper jam caused around the gate GT1, visual check of the jammed sheet or removal of the jammed sheet is facilitated.

Particularly, in the example 1, the third link 14 has the inclined portion 14*d* at the lower end. In a structure excluding the inclined portion 14*d*, the contacted surface 16 would come into contact with the lower end of the third link 14 before the gate GT1 moves to the state illustrated in FIGS. 10A and 10B, so that the range in which the gate GT1 is movable is reduced. In contrast, in the example 1, the inclined portion 14*d* is prevented from coming into contact with the gate GT1, so that the gate GT1 is allowed to move widely. This structure thus further facilitates visual check or removal of a paper jam.

In this state, the positioning plate 7 is apart from the stopblock 21, and thus the gate GT1 is movable freely. Unlike the case where the gate GT1 is fixed in position during removal of jammed paper, no load is born on the movable gate GT1, and the gate GT1 is thus prevented from being broken.

The reverse roller Rb, the gate GT1, and the components denoted with 1 to 21 constitute a medium transport device according to the example 1.

Operations of Example 1

In the copying machine U according to the example 1 having the above structure, the gate GT1 has to move to the first gate position when the recording sheet S is to be discharged to the lower paper output tray TRh. Here, the solenoid 11 is kept off (in the nonoperational state), and the gate GT1 is held in the first gate position with the force of the gate spring 8. The gate GT1 is fixed in the first gate position with the positioning plate 7 and the stopblock 21 coming into contact with each other.

In this state, the locking portion 13*b* faces the lock piece 6. Thus, the gate GT1 that is to rotate to the second gate position is prevented from moving as a result of the lock piece 6 coming into contact with the locking portion 13*b* (in other words, the movement of the gate GT1 is restricted or limited). Specifically, the gate GT1 is locked to be unmovable.

When the recording sheet S is to be discharged to the upper paper output tray TRh2 or to be subjected to double-side printing, the gate GT1 has to move to the second gate position. Here, the solenoid 11 is turned on (in the operational state). When the solenoid 11 is turned on, the first link 12 is pulled rearward. When the first link 12 is pulled rearward, the lower end of the second link 13 rotates forward, and concurrently, the coupling portion 13*c* rotates downward. With the movement of the lower end of the second link 13, the locking portion 13*b* moves away from the lock piece 6. Thus, the gate GT1 becomes movable toward the second gate position, or, becomes unlocked.

When the coupling portion 13*c* moves downward, the third link 14 moves downward. When the third link 14 moves downward, the press-down portion 14*c* presses down the contacted surface 16. Thus, the gate GT1 moves to the second gate position.

In the example 1, the third link 14 is coupled to the second link 13 with the long hole 13*d*. A time lag occurs after the second link 13 starts moving and before the third link 14 starts moving. A time lag also occurs after the third link 14 starts moving and before the third link 14 starts pressing the gate GT1, since the lower end of the third link 14 is spaced apart from the contacted surface 16. These time lags allow the locking portion 13*b* to be fully spaced apart from the lock piece 6 before the gate GT1 starts moving toward the second gate position. Compared to the structure in which unlocking occurs concurrently with the start of the movement of the gate GT1, this structure reduces movement errors of the gate GT1 or erroneous guide of recording sheets S due to movement errors of the gate GT1.

Subsequently, to transport the recording sheet S toward the reverse path SH6 for double-side printing, the gate GT1 needs to move to the first gate position. When the recording sheet S is to be transported to the reverse path SH6, the solenoid 11 is switched from on to off. Thus, the gate GT1 rotates toward the first gate position with the force of the gate spring 8. In addition, the force from the solenoid 11 is no longer exerted, and the third link 14 is pushed upward with the force of the return spring 15. Accordingly, the second link 13 rotates rearward and the first link 12 moves forward. Thus, the locking portion 13*b* faces the lock piece 6, and the gate GT1 is returned to be locked in the first gate position.

Even if the gate GT1 is returned to the first gate position with delay, the inclined surface 13*b*2 of the locking portion 13*b* comes into contact with the lock piece 6, and the lock piece 6 is pressed by the inclined surface 13*b*2, which supports the gate GT1 in its return to the first gate position. Thus, the gate GT1 is surely returnable to the first gate position.

Thus, in the medium transport device according to the example 1, the gate GT1 moves between the first gate position and the second gate position in conjunction with the operation or the stop of the solenoid 11.

Here, in the structure of an existing gate, the gate is held in the first gate position according to the example 1 with only the force of spring. This is because, usually, discharging the recording sheets to the lower paper output tray in a single-side printing is more frequently performed than the double-side printing. Thus, the use of a spring is reasonable to hold the gate in the frequently placed first gate position without electric power, and to move the gate to the second gate position with the operation of a driving source (with electric power) such as a motor or a solenoid for double-side printing, which is performed less frequently.

Here, also in an existing structure, the recording sheets are guided while being in contact with the gate held with the force of the spring. If the recording sheets are stiff media, such as cardboard, such recording sheets press the gate with a strong force. Particularly, the leading ends of the recording sheets in the transport direction collide against the gate with a strong force.

In the existing technology for holding the gate in the first gate position with only a spring, the spring force may be insufficient and allow the gate to rotate toward the second gate position if the gate receives a strong force from the recording sheet in the structure, as in the example 1 where the gate in the first gate position also guides the recording sheet to the reverse path. When the gate rotates, the recording sheet may be transported rearward to the fixing device, instead of the reverse path, and may be guided erroneously.

Continuously operating a motor or using a highly elastic spring as a gate spring to transport a recording sheet to the reverse path to avoid erroneous guide may increase the running cost or manufacturing cost. Moreover, a highly elastic spring allows the gate to forcibly rotate when the solenoid is turned off, and to be returned to the first gate position and stop by colliding against the stopblock with a large noise (unusual sound).

To avoid these, in the example 1, the lock piece 6 and the locking portion 13*b* are held while being close to each other when the gate GT1 is moved to the first gate position. Thus, when the gate GT1 is pressed by the recording sheet S to move toward the second guide position, the locking portion 13*b* comes into contact with the lock piece 6 and blocks or restricts rotation of the gate GT1. The gate GT1 is thus prevented from moving from the first gate position, so that erroneous guide of the recording sheet S is prevented. Thus, the structure according to the example 1 reduces erroneous guide of the recording sheets S while restricting an increase of costs such as the running cost, compared to the existing structure in which the gate is held in the first gate position with only a spring.

Particularly, in the example 1, a spring exerting a force of returning the gate GT1 to the first gate position or returning the third link 14 to the upper position is sufficient for the gate spring 8 or the return spring 15, and a strong spring resistant to the impact caused when the recording sheet S collides against the gate GT1 is not needed. This structure thus employs an inexpensive spring having lower elasticity than a spring for an existing technology for holding the gate in the first gate position using only the spring. Thus, the manufacturing cost is reduced, and noise is reduced.

The gate GT1 returns from the second gate position to the first gate position with the gate spring 8. Thus, the example 1 does not involve the use of electric power for the return to enable reduction of the running cost.

Particularly, in the example 1, the gate GT1 is allowed to be held in the frequently placed first guide position without operating the solenoid 11. Thus, the running cost is further reduced than in the case of holding the gate by operating the solenoid 11.

EXAMPLE 2

Figure 11:
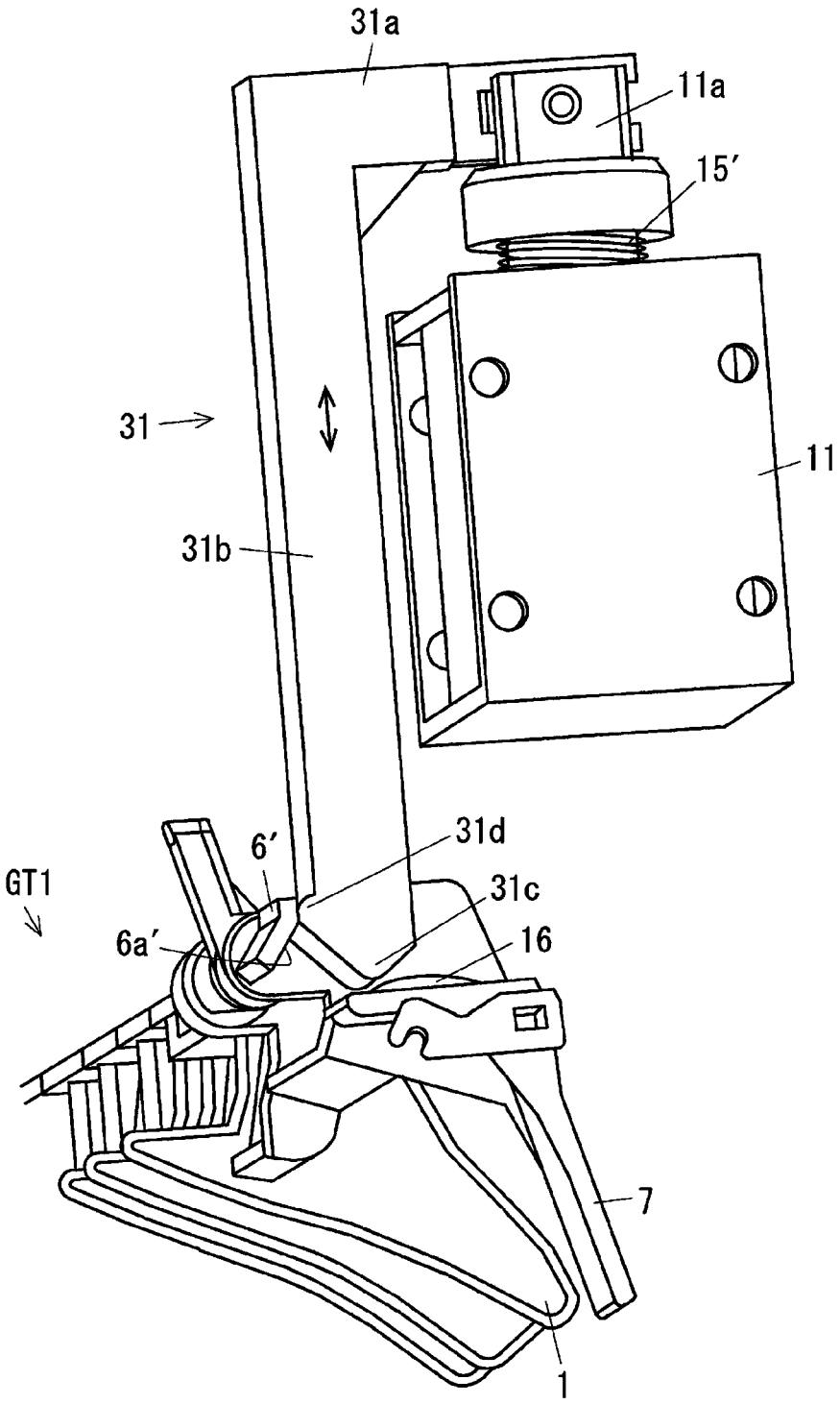
FIG. 11 illustrates a gate driving mechanism according to an example 2, where a second moving member is moved to the first position.

FIG. 11 illustrates a gate driving mechanism according to an example 2, where a second moving member is moved to the first position.

Figure 12:
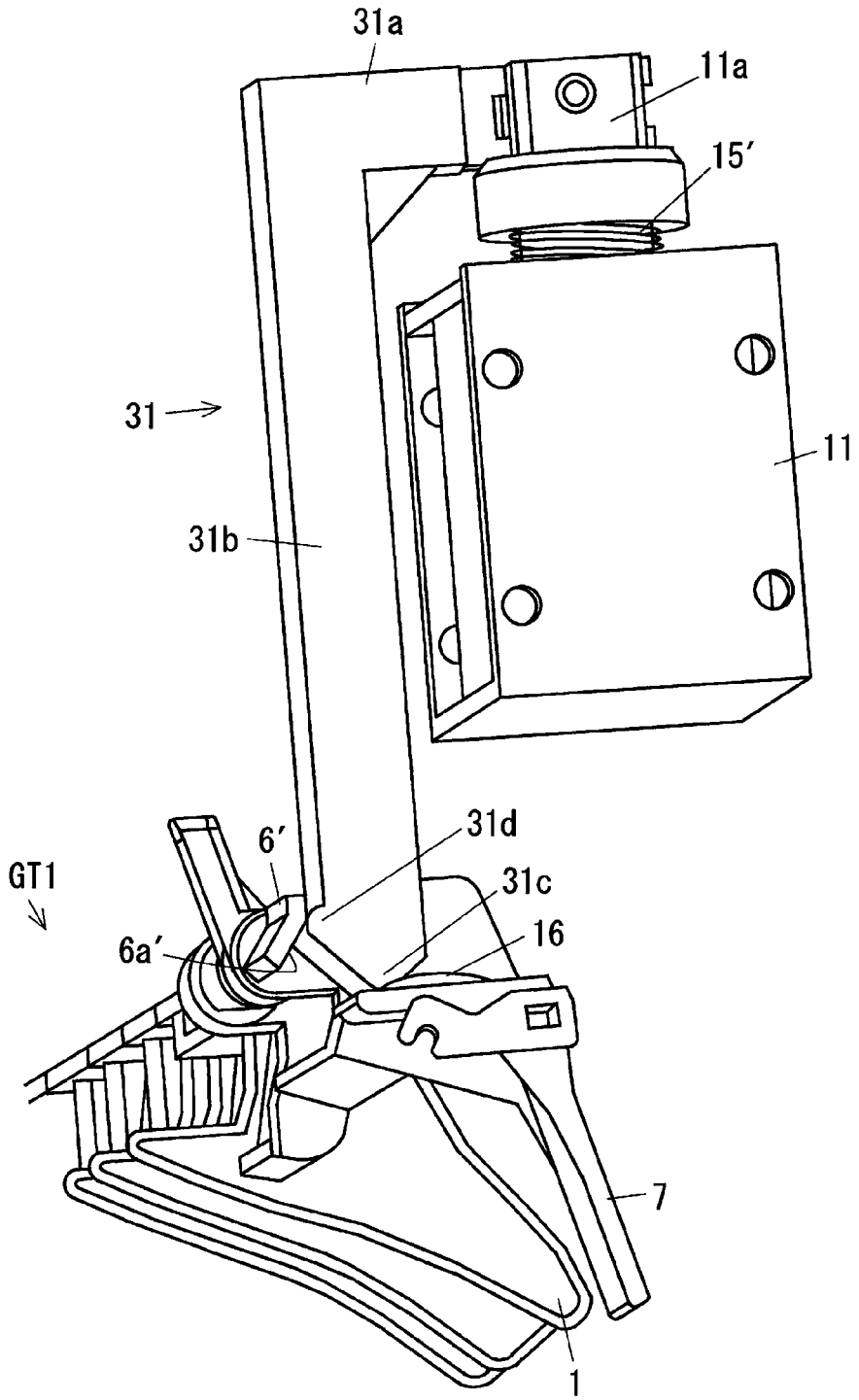
FIG. 12 illustrates a gate driving mechanism according to the example 2, in the state where a second moving member is moving from the first position to the second position.

FIG. 12 illustrates the gate driving mechanism according to the example 2, in the state where a second moving member is moving from the first position to the second position.

Figure 13:
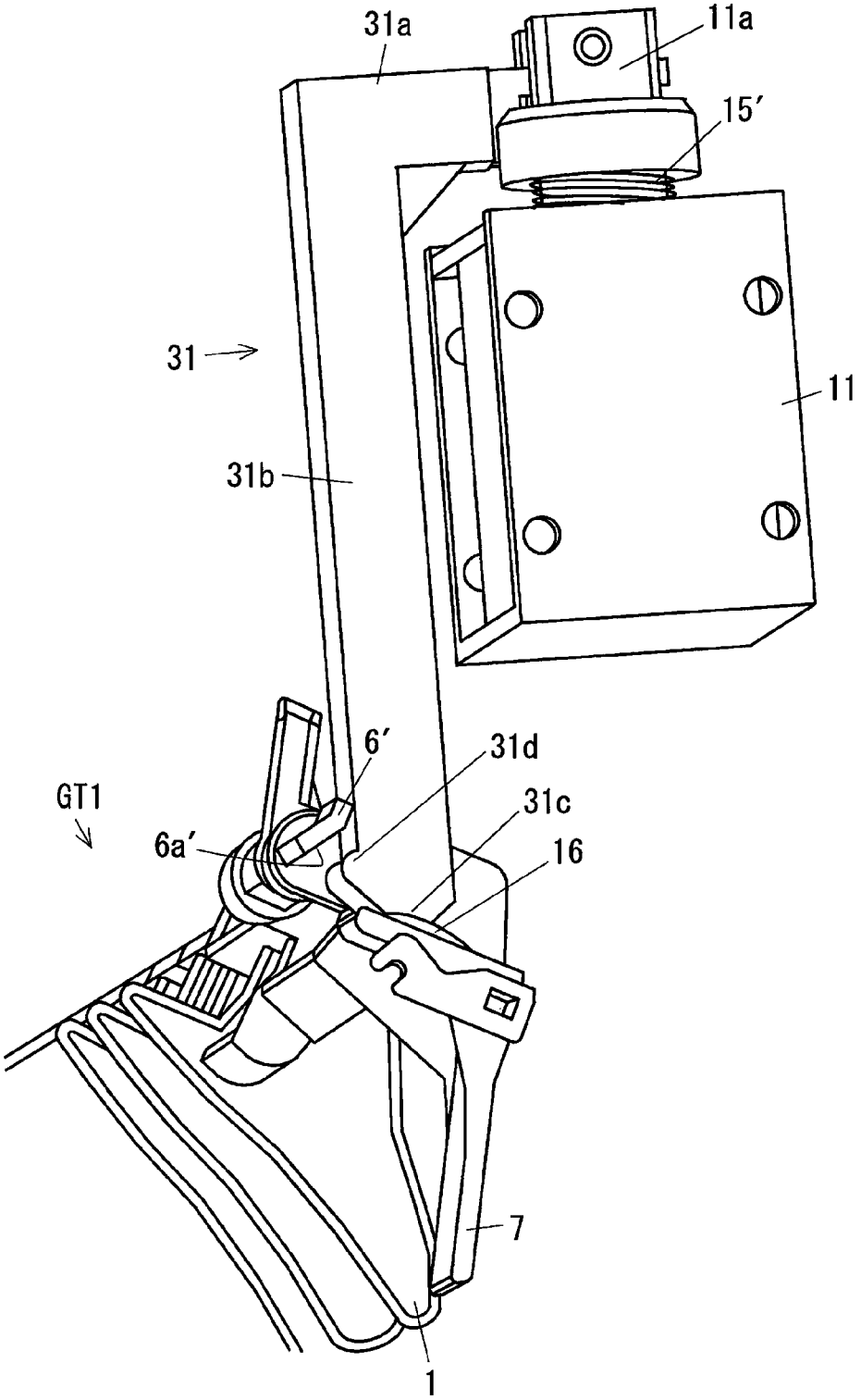
FIG. 13 illustrates the gate driving mechanism according to the example 2, where the second moving member is moved to the second position.

FIG. 13 illustrates the gate driving mechanism according to the example 2, where the second moving member is moved to the second position.

An example 2 of the disclosure is described now. In the description of the example 2, components corresponding to the components according to the example 1 are denoted with the same reference signs, and not described in detail.

The example 2 is different from the example 1 in the following points, but the same in the other points.

In FIG. 11 to FIG. 13, unlike in the example 1, in the medium transport device according to the example 2, the plunger 11*a* of the solenoid 11 is vertically retractable. In the example 2, a return spring 15', which is an example of a second return member that urges the plunger 11*a* upward, is attached to the plunger 11*a*.

The example 2 includes one link 31, unlike in the example 1 that includes the three links 12 to 14. The link 31 includes an upper portion 31*a*, which extends horizontally. A first end of the upper portion 31*a* is coupled to the plunger 11*a*. A link body 31*b* extends downward from a second end of the upper portion 31*a*.

At the lower end of the link body 31*b*, a press-down portion 31*c*, which is an example of a first movement member, is disposed. The press-down portion 31*c* according to the example 2 has a curved lower surface, and is held apart from the contacted surface 16 when the gate is in the first gate position.

Above the press-down portion 31*c*, a locking portion 31*d*, which protrudes rightward, is disposed as an example of a second moving member. The locking portion 31*d* has a curved right surface.

At a lower portion of a lock piece 6' according to the example 2, an inclined surface 6*a*' is disposed as a component corresponding to the inclined surface 13*b*2 according to the example 1. The inclined surface 6*a*' is inclined rightward as it extends downward to correspond to the position and the movement direction (vertical direction) of the locking portion 31*d*.

Operations of Example 2

In the medium transport device according to the example 2 having the above structure, the locking portion 31*d* faces or adjoins to the lock piece 6' while the solenoid 11 is turned off, as illustrated in FIG. 11. Thus, the gate GT1 in the first gate position is locked with the locking portion 31*d* and the lock piece 6'.

When the solenoid 11 is turned on, the locking portion 31*d* moves away from the lock piece 6' in the state illustrated in FIG. 12 to unlock the gate GT1, and the press-down portion 31*c* presses the contacted surface 16 downward. Thus, as illustrated in FIG. 13, the gate GT1 moves to the second gate position.

Thus, as in the case of the example 1, the medium transport device according to the example 2 also reduces erroneous guide of the recording sheets S while reducing an increase of costs such as the running cost, compared to the existing structure in which the gate is held in the first gate position with only a spring.

Modified Examples

Thus far, the examples of the present disclosure have been descried in detail. However, the disclosure is not limited to the above-described examples, and may be modified in various manners within the scope of the gist of the present disclosure described in the scope of claims. Modified examples H01 to H09 of the present disclosure are described, below, by way of examples.

H01

In the above examples, the copying machine U has been described as an example of an image forming apparatus. The present disclosure is not limited to this, however. The image forming apparatus is applicable to a FAX machine, or a multifunctional printer having multiple functions such as a FAX machine, a printer, and a copying machine. The image forming apparatus is not limited to an electrophotographic image forming apparatus, and is applicable to an image forming apparatus of any image forming form such as ink jet printing, or photolithographic printing including thermal head printing. In addition, the image forming apparatus is not limited to an image forming apparatus for multi-color development, and may be an image forming apparatus for forming single-color or monochrome images.

H02

The above example has described a structure, by way of example, including the paper output trays TRh and TRh2 vertically arranged in two levels. However, the structure may include paper output trays arranged in three or more levels. The above example has described a structure, by way of example, including a medium transport device disposed in the printer unit U1. This is not the only possible structure, however. The disclosure is also applicable to a structure for a postprocessor including a transport path including a gate.

H03

The above example has described a structure, by way of example, including the solenoid 11 as an example of a driving source and the links 12 to 14 for transmitting a driving force. This is not the only possible structure, however. The disclosure is also applicable to a structure including, for example, a motor, a gear, a pinion, and a rack.

H04

In the above example, desirably, the lower end of the third link 14 or the press-down portion 31*c* is kept apart from the contacted surface 16 while the gate is in the first gate position. This is not the only possible structure, however. The disclosure is also applicable to a structure where they are in contact with each other or the gate GT1 and the third link 14 or other components are coupled together via, for example, a long hole as long as this structure secures a time lag for lock release after the gate GT1 starts moving and before the lock piece 6 or 6' comes into contact with the locking portion 13*b* or 31*d*.

H05

In the above example, desirably, the solenoid 11 is operated to move the gate to the second gate position, but the solenoid may be operated to move the gate to the first gate position.

H06

The above example has described a structure including the open-close cover Ub that includes the stopblock 21.

This is not the only possible structure, however. For example, the frame Ua may include the stopblock 21.

H07

In the above example, desirably, the contacted surface 16 is curved, but may be flat.

H08

The above example has described a structure, by way of example, in which the gate GT1 is returned to the first gate position with the gate spring 8. This is not the only possible structure, however. For example, the disclosure is also applicable to a structure in which the gate GT1 is returned to the first gate position with its weight in relation to the center of gravity of the gate GT1 and the shaft 3 without including the gate spring 8.

H09

The above example desirably includes the inclined surface 13*b*2 or 6*a*', but may not include the inclined surface 13*b*2 or 6*a*'.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium transport device comprising:

a medium guide member movable between a first guide position, in which the medium guide member guides a medium toward a receiving member on which the medium is loaded, and a second guide position, in which the medium guide member guides the medium from the receiving member into the device;

a driving source that moves the medium guide member;

a first movement member that moves the medium guide member in accordance with an operation of the driving source;

a movement restricting member movable together with the medium guide member; and a second moving member that is movable between a first position, in which the second moving member is located close to the movement restricting member to restrict the medium guide member from moving from the second guide position to the first guide position, and a second position, in which the second moving member is spaced apart from the movement restricting member to allow the medium guide member to move to the first guide position, the second moving member moving from the first position to the second position when the medium guide member moves toward the first guide position in response to an operation of the driving source.

2. The medium transport device according to claim 1, wherein the first movement member moves the medium guide member toward the first guide position after the second moving member moves to the second position.

3. The medium transport device according to claim 2, wherein the first movement member is movable toward and away from the medium guide member, wherein the first movement member is spaced apart from the medium guide member when the medium guide member is in the second guide position, wherein the first movement member moves toward the medium guide member when the second moving member moves toward the second position, and wherein the first movement member comes into contact with the medium guide member after the second moving member finishes moving to the second position.

4. The medium transport device according to claim 3, further comprising:

a positioning member that comes into contact with the medium guide member to fix the medium guide member in the second guide position; and an open-close member that renders a medium transport path open or closed, wherein the first movement member does not come into contact with the medium guide member that moves when the open-close member is opened.

5. The medium transport device according to claim 4, wherein the medium guide member has a curved surface at a portion at which the medium guide member comes into contact with the first movement member.

6. The medium transport device according to claim 5, wherein the first movement member is coupled to the driving source via the second moving member.

7. The medium transport device according to claim 4, wherein the first movement member is coupled to the driving source via the second moving member.

8. The medium transport device according to claim 3, wherein the medium guide member has a curved surface at a portion at which the medium guide member comes into contact with the first movement member.

9. The medium transport device according to claim 8, wherein the first movement member is coupled to the driving source via the second moving member.

10. The medium transport device according to claim 3, wherein the first movement member is coupled to the driving source via the second moving member.

11. The medium transport device according to claim 2, wherein the first movement member is coupled to the driving source via the second moving member.

12. The medium transport device according to claim 1, wherein the first movement member is coupled to the driving source via the second moving member.

13. The medium transport device according to claim 12, wherein the first movement member is coupled to the second moving member via a long hole.

14. The medium transport device according to claim 1, further comprising:

a first urging member that exerts a force of pressing the medium guide member toward the second guide position.

15. The medium transport device according to claim 1, further comprising:

a second urging member that exerts a force of pressing the first movement member toward a position apart from the medium guide member.

16. The medium transport device according to claim 1, wherein the second moving member includes an inclined surface that is inclined in a direction away from the movement restricting member as the second moving member moves from the first position to the second position.

17. An image forming apparatus, comprising:

an image forming member that forms an image on a medium; and the medium transport device according to claim 1 that transports a medium on which an image is formed by the image forming member.

* * * * *